United States Patent [19]

Marshall

[11] 4,423,541

[45] Jan. 3, 1984

[54] ROLLING MILL ROLL

[75] Inventor: Robert Marshall, Sheffield, England

[73] Assignee: Davy-Loewy Limited, Sheffield, England

[21] Appl. No.: 319,723

[22] Filed: Nov. 9, 1981

[30] Foreign Application Priority Data

Nov. 11, 1980 [GB] United Kingdom ..... 8036178

[51] Int. Cl.[3] ..... B60B 9/00; B21B 31/08

[52] U.S. Cl. ..... 29/117; 29/123; 29/125; 384/99; 384/267

[58] Field of Search ..... 29/117, 122, 123, 125, 29/129, 129.5; 384/99, 267, 268; 277/113, 115, 116, 123

[56] References Cited

U.S. PATENT DOCUMENTS 4,253,392 3/1981 Brandon et al. ..... 29/117

FOREIGN PATENT DOCUMENTS 525491 4/1931 Fed. Rep. of Germany ..... 29/117

*Primary Examiner*—Mark Rosenbaum
*Assistant Examiner*—Timothy V. Eley
*Attorney, Agent, or Firm*—Lee, Smith & Jager

[57] ABSTRACT

A rolling mill roll having adjustable axial compliance is formed by a sleeve in the bore of which is located a stiffening arbor. The arbor is an interference fit with the bore of the sleeve over a limited central part of the roll but on each side of that central part is stepped in diameter to form, at each side, a divergent stepped space between arbor and sleeve. That space is occupied by a number of annular wedges which normally do not give support to the sleeve. At each end of the roll there is a hydraulic actuator which applies axial force to the wedges at that side and expand the wedges progressively against the sleeve. By varying the force applied by each actuator the number of wedges supporting the sleeve can be adjusted, thereby to vary the length of the sleeve supported by the arbor.

4 Claims, 2 Drawing Figures

ROLLING MILL ROLL

This invention relates to a roll for a rolling mill, and particularly to a roll capable of being adjusted to vary the axial compliance of the mill.

In U.S. patent application Ser. No. 282,717 of R. W. Gronbech and R. Marshall, filed July 13, 1981, there is described a hollow roll which is stiffened by an arbor which is centrally located within the roll and which is an interference fit with the roll bore over a central axial length of the roll. By selecting the length of the arbor, the length of the stiffened part of the roll may be varied to adjust the axial compliance of the roll. In particular, the stiffened part of the roll may be adjusted to correspond to the width of strip to be rolled in the mill.

The arrangement of said earlier application, entailing an arbor formed by a number of discs chosen according to the required support length, has the disadvantage that, to change the support length to comply with a change in width of the strip to be rolled, the roll is required to be removed from the mill and discs added or removed. The present invention aims to provide in one embodiment a roll so constructed that the stiffened length may be adjusted with the roll in situ.

Thus, according to one aspect of the present invention, a roll for a rolling mill comprises:

(a) a sleeve having an axial length corresponding to the barrel length required of the roll;

(b) an arbor within the sleeve but spaced from the sleeve at least at one end, (c) ring means between the bore of the sleeve and the arbor for causing the sleeve to be supported by the arbor; and (d) adjustment means acting on the ring means for varying the axial length of support given by the arbor to the sleeve.

In a preferred form of the invention, the roll comprises:

(a) a sleeve having an axial length corresponding to the barrel length required of the roll;

(b) an arbor within the sleeve engaging directly the bore of the sleeve over part of the axial length of both the sleeve and the arbor, but spaced from the sleeve at one end at least, (c) adjustable annular wedge means between the arbor and the sleeve where the sleeve is spaced from the arbor, (d) means whereby the support given by the arbor to the sleeve is extended from the part at which there is direct engagement.

Preferably there is direct engagement between the sleeve and the arbor over a central part of the roll, and there are adjustable wedge means, as described above, at each end of the roll.

BRIEF DESCRIPTION OF THE DRAWINGS

The invention will be more readily understood by way of example from the following description of a rolling mill roll in accordance therewith, reference being made to the accompanying drawings, of which FIGS. 1A and 1B taken together are an axial section through one half of the roll.

DESCRIPTION OF THE PREFERRED EMBODIMENT

Figure 1A:
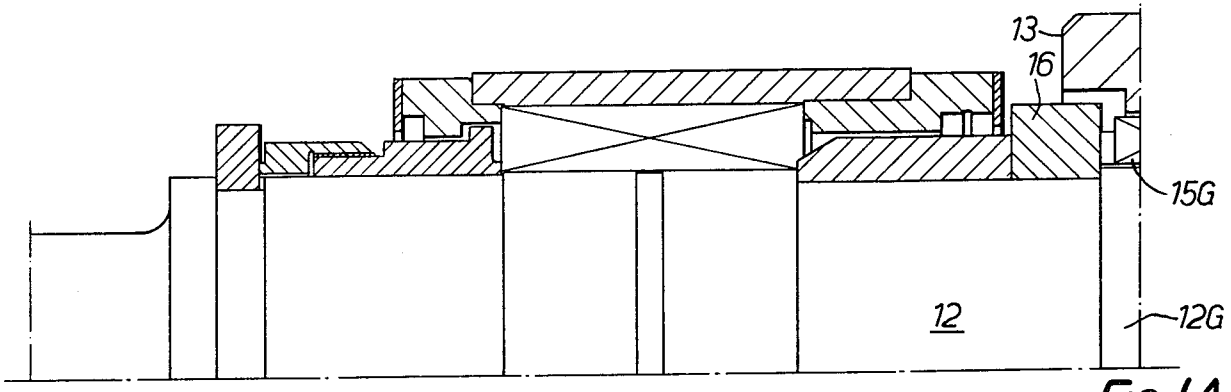
Figure 1B:
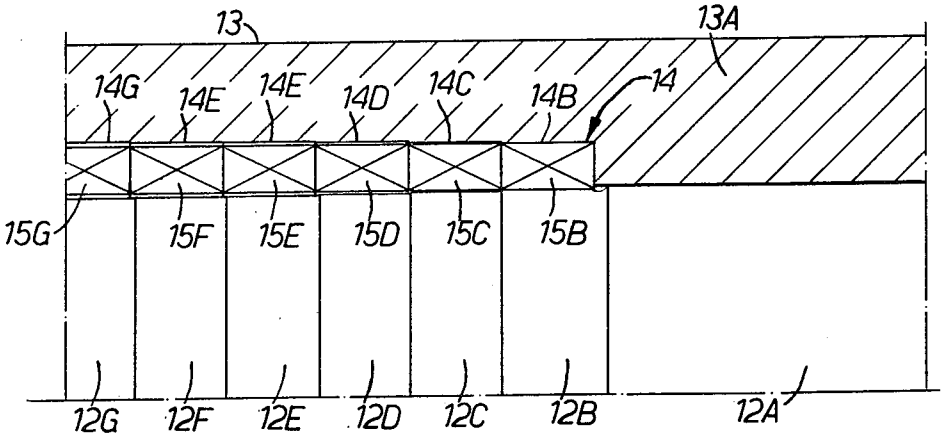

In the drawings only that part above the roll axis and to the left of the median line is shown, and it is to be understood that the roll is symmetrical about its axis and that the right hand and left hand halves of the roll are mirror images of one another.

The roll has an arbor 12 formed at each end with a roll neck by which the roll is journalled in bearings in the roll housings (not shown). Over a central part 12A, the arbor has a constant diameter, but over each effective end of the arbor the diameter is reduced in small steps from that part 12A, as shown in 12B–12G.

A sleeve 13 is carried on the arbor 12 and extends over the effective length of the latter. The central part 13A of the sleeve is an interference fit with the central part of the arbor so that that part is permanently stiffly supported by the arbor. On each side of the central part 13A, the bore of the sleeve is stepped as shown at 14, the diameter of the stepped bore increasing in steps 14B–14G from the central part 13A, to correspond approximately with the stepped parts 12B–12G of the arbor. A divergent, stepped, annular space is thus formed between the sleeve and the arbor at each end of the sleeve.

At each end of the sleeve, a number of annular wedge elements 15B–15G are inserted between the rebated bore of the sleeve 13 and the stepped part of the arbor 15. In its initial form, each wedge element 15 has an axial length corresponding to the length of an arbor step and a radial width slightly smaller than the spacing between the steps 12B and 14B. When the elements 15 are in that condition they provide no support for the sleeve, with the result that the roll is relatively stiff over the length of the central part 12A of the arbor, and relatively compliant over the ends.

The stiffened length of the roll is increased by means of an actuator 16 at each end of the arbor. When hydraulically operated, the actuator 16 applies axial forces to the end element 15G, and through it to the other elements 15F–15B. The effect of the application of the forces is to expand the wedge elements successively, starting with the element 15B which is restrained from axial movement; the number of elements so expanded depends on the magnitude of the forces applied by the actuator 16. When an element 15 is expanded against the contiguous faces of the arbor and sleeve, it provides stiffening support for the sleeve, with the consequence that the stiffened length of roll can be increased by a given axial length dependent on the force of the actuator 16.

The elements 15 may have any desired form capable of producing the necessary radial expansion when subject to axial forces. For example, the element may consist of two rings, one within the other and with tapered faces in contact with one another. It is however preferred to employ elements made and sold under the trade name "RINGFEEDER", comprising three concentric rings of which the central ring is actuated directly or indirectly by the actuator 16 and has wedge faces engaging complementary faces on the other rings.

The central stiffened part of the sleeve 13A may have a length slightly less than the minimum width of strip to be rolled, while the overall axial length of the sleeve 13 is slightly greater than the maximum width of strip that can be rolled on the mill. The forces applied by the two actuators 16, and hence the stiffened length of the roll, are chosen according to the strip width to be rolled.

A roll as described may be employed for one or each of the work rolls of a four-high mill; as the intermediate roll of a five-high mill; or as one or each of the intermediate rolls of a six-high mill. Such mills have been described in the said U.S. patent application.

I claim:

1. A rolling mill having adjustable axial compliance comprising:

a. a sleeve having an axial bore;

b. an arbor within said bore and engaging said sleeve over a limited central part;

c. said arbor being spaced from said sleeve to form at each side of said central part an axially extending annular space; and d. in each said annular space, a plurality of annular wedge devices about said arbor;

e. said wedge devices being contiguously axially arranged in said space from said central part and being expansible to adjust the length of continuous support given by said arbor to said sleeve.

2. A rolling mill roll as claimed in claim 1, including a hydraulic actuator at each end of said arbor to apply axial force to said wedge devices to expand said wedge means against said sleeve and said arbor and vary the axial length of support given by said arbor to said sleeve.

3. A rolling mill having adjustable axial compliance comprising:

a. a sleeve having an axial bore;

b. an arbor within said bore and engaging said sleeve over a limited central part;

c. at least one of said bore and said arbor being stepped in diameter axially from said central part at each side thereof to form at each side of said central part a plurality of contiguous annular spaces between said arbor and said bore of progressively increasing radial width; and d. in each said annular space, an annular wedge device which is expansible against said sleeve and said arbor.

4. A rolling mill roll as claimed in claim 3, including a hydraulic actuator at each end of said arbor to apply axial force to said wedge devices to expand said wedge means against said sleeve and said arbor and vary the axial length of support given by said arbor to said sleeve.

* * * * *